United States Patent [19]

Jordan et al.

[11] Patent Number: 4,943,177

[45] Date of Patent: Jul. 24, 1990

[54] DOCUMENT ORGANIZER

[75] Inventors: Shelby A. Jordan, Corpus Christi; John W. Apgar, Sr., Houston, both of Tex.

[73] Assignee: Litigation Innovations, Inc., Houston, Tex.

[21] Appl. No.: 267,358

[22] Filed: Nov. 4, 1988

[51] Int. Cl.[5] ..... B42F 13/22

[52] U.S. Cl. ..... 402/72; 402/75; 402/80 R; 402/502; 248/456

[58] Field of Search ..... 402/77, 72, 80 R, 70, 402/73, 75, 502; 211/2; 248/456

[56] References Cited

U.S. PATENT DOCUMENTS

| | | | |
|---|---|---|---|
| 1,722,811 | 7/1929 | Martin | 248/454 |
| 1,923,351 | 8/1933 | Woodley | 281/33 |
| 1,990,965 | 2/1935 | Unger | 402/75 |
| 2,224,530 | 12/1940 | Weinstein | 45/80 |
| 2,286,128 | 6/1942 | Unger | 248/441 |
| 2,333,523 | 11/1943 | Cohun | 402/77 |
| 2,463,946 | 3/1949 | Brook | 402/75 |
| 2,595,064 | 4/1952 | Ericson | 281/33 |
| 3,091,482 | 5/1963 | Cirigliano | 402/73 |
| 4,240,761 | 12/1980 | Jacobson | 402/72 |
| 4,315,696 | 2/1982 | Ermanski et al. | 402/70 |
| 4,420,270 | 12/1983 | Rossello | 281/33 |
| 4,487,590 | 12/1984 | Becker et al. | 281/15.1 X |
| 4,616,851 | 10/1986 | Mann | 281/15.1 |

*Primary Examiner*—Paul A. Bell
*Assistant Examiner*—Y. Lin
*Attorney, Agent, or Firm*—G. Turner Moller

[57] ABSTRACT

A organizer for a large number of documents comprises a rigid backing member, a front cover and a back cover, both pivotally mounted to the backing member. The backing member is sufficiently wide to receive a plurality of removable parallel conventional ring binder assemblies and accordingly includes a plurality of mechanisms to receive the binder assemblies. The ring binder assemblies comprise a rigid spine, a plurality of rings and a mechanism to open and close the rings to receive perforated pages thereon. The front and back covers preferably provide handle holes set back from the edges a distance such that the end pages overlie the user's fingers when the organizer is picked up. In this fashion, the leading edges of the end pages do not cut the user's fingers. In addition, a retractable stand is provided for supporting the ring binders at an inclined readable angle.

11 Claims, 1 Drawing Sheet

DOCUMENT ORGANIZER

The invention relates to a device for receiving and organizing a large number of documents for immediate retrieval.

There are many situations where an individual has to have a large number of paper documents organized so a particular page or document can be immediately reviewed. A classic example is an attorney trying a document intensive case, such as a complex commercial transaction. It is not uncommon to try a case having a hundred documents comprising many thousands of pages of depositions, exhibits and the like which are needed immediately. A particularly acute situation occurs in Federal District Courts where an attorney examining a witness must stand at a microphone to ask questions and periodically refer to exhibits entered in the case, consult depositions of the witness, or refer to transcripts of the testimony of prior witnesses.

There is presently no commercially available exhibit book or organizer for a large number of documents which is designed to solve this problem. The closest thing seen by most people are price book holders in auto parts stores where several large price books reside on an incline with a vertical rod extending through the middle of each price book to hold it in place. Somewhat similar arrangements are shown in U.S. Pat. Nos. 1,722,811 and 2,286,128 where racks are provided for holding multiple loose leaf binder books. These devices provide means for holding conventional binder books which include a spine, a rigid front and a rigid back, both pivotally connected to the spine.

There are presently available three ring binder books in which the ring assembly is mounted on a metal spine which is removable from the paper board spine visible from the exterior of the binder. Other disclosures of some interest relative to this invention are found in U.S. Pat. Nos. 1,923,351; 2,224,530; 2,595,064; 4,420,270 and 4,487,590.

In summary, this invention comprises an exhibit book or organizer for a large number of documents comprising a backing member including a rigid spine having more-or-less rigid front and back covers pivotally connected to the spine along generally parallel axes. The spine provides a plurality of parallel slide type receivers for receiving the back of a plurality of ring binder assemblies. The ring binder assemblies each comprise a spine, a plurality of separable ring sets which are movable from an open position to receive perforated pages to a closed position to retain the pages. The pages in the binder assemblies are free to move from side to side as the user flips to the desired document and page. Because the binder assemblies do not have rigid fronts and backs: (1) the first and last pages in the organizer are free to abut the rigid front and back of the backing member and (2) the first and last pages of any interior binder assemblies abut the adjacent pages of the adjacent binder assemblies.

It is accordingly an object of this invention to provide an improved exhibit book or organizer for a large number of pages.

Another object of this invention is to provide an organizer for a large number of pages comprising a holder for a plurality of removable ring binder assemblies.

These and other objects of this invention will become more fully apparent as this description proceeds, reference being made to the accompanying drawings and appended claims.

IN THE DRAWINGS

Figure 1:
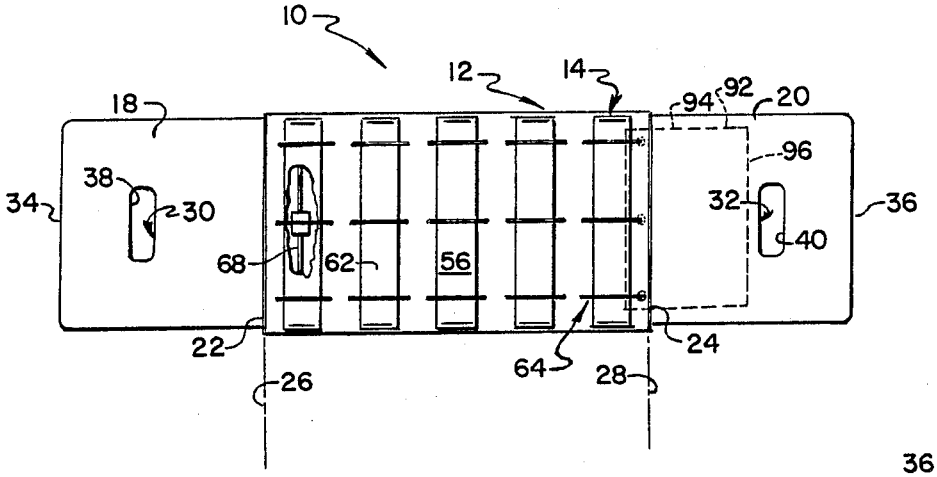
FIG. 1 is a top plan view of an exhibit book or organizer of this invention showing five binder assemblies therein.

Referring to FIGS. 1–4, an organizer or exhibit book 10 of this invention comprises, as major components, a rigid backing member or spine 12 and a plurality of ring binder assemblies 14 removably received on the backing member 12.

The backing member 12 pivotally connects to a front or front cover 18 and a back or back cover 20. Although the front and back covers 18, 20 may be pivotally connected to the spine 12 by a fabric material covering the backing member, as in a conventional hard back book, the pivotal connection preferably comprises a pair of piano hinges 22, 24 mounting the front and back 18, 20 for pivotal movement about generally parallel axes 26, 28. The backing member 12 is necessarily fairly rigid to take the load of the binder assemblies 14 as will be evident hereinafter. Theoretically, the front and back covers 18, 20 do not have to be quite as stiff because they are not subjected to the same type load as the backing member 12. As a practical matter, the backing member 12, front cover 18 and back cover 20 are preferably made of the same material which may be any of suitable type but which is conveniently a vinyl clad aluminum, which is a conventional material for constructing binders.

The size of the backing member 12 largely depends on the number of binder assemblies 14 to be carried by the organizer. Although any desired number of binder assemblies 14 are feasible, organizers of this invention are most desirable when 3–5 binder assemblies are used. The front and back covers 18, 20 may be of any desired size but are conveniently designed to accommodate letter sized paper, i.e. $8\frac{1}{2}'' \times 11''$. The covers 18, 20 are accordingly conventionally sized and are preferably about $11'' \times 11''$, i.e. slightly larger than letter size. The covers 18, 20 are larger than letter size in the width dimension because of the depth of the ring sets, as will be more fully apparent hereinafter.

A major advantage of the piano hinges 22, 24 is that the front and back covers 18, 20 may be folded underneath the backing member 12. This allows additional exhibit books to abut either end of the organizer 10.

The front and back covers 18, 20 each provide a handle hole 30, 32 at a location spaced from the free edge 34, 36 an unusual distance. When a person lifts the exhibit book 10, the natural technique is to place the fingers through the handle holes 30, 32 with the thumbs on or above the edges 34, 36. The person's fingers accordingly act against a lifting edge 38, 40 of the handle holes 30, 32. As will be explained more fully hereinafter, the lifting edges 38, 40 are spaced from the edges 34, 36 a greater distance than the normal span of an adult hand from the base or first joint of the thumb to the second joint of the fingers, i.e. a distance of about 3½ inches or greater.

Figure 2:
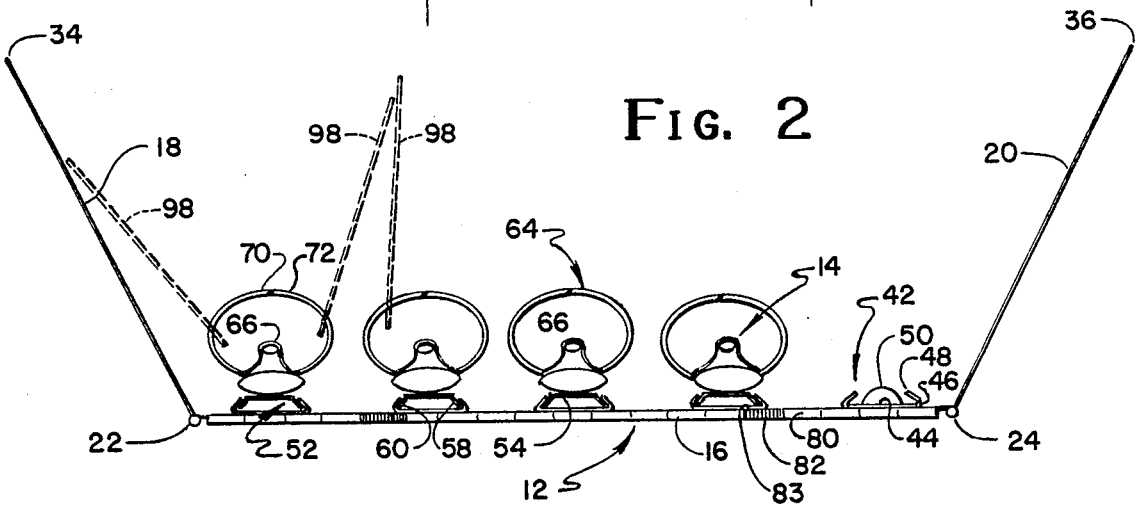
FIG. 2 is a front elevational view of the exhibit book of FIG. 1, certain parts being removed for purposes of illustration.

Mounted on the rigid spine 12 is a plurality of binder assembly receivers 42 of any suitable type. As shown best in FIGS. 2 and 4, the binder assembly receivers 42 comprise a flat metallic central section 44 secured to the spine 12 having a pair of parallel side edges 46 and a pair of elongate converging sides or lips 48 defining a track for receiving the binder assemblies 14. The track is open at one end of the receivers 42, corresponding to the top of the organizer 10, to allow entry of the binder assemblies 14 and is at least partially closed at the bottom end by an abutment 50 (FIG. 4 and right end of FIG. 2) to prevent the binder assemblies 14 from falling out of the receivers 42. The abutment 50 is seen in FIG. 2 only on the receiver 42 not having a binder assembly 14 therein.

A plurality of ring binder assemblies 14 are received in the exhibit book 10 comprising a metallic slide 52 including a planar section 54 and a pair of downwardly diverging sides 58, 60 sized to be closely received by the track of the receivers 42. The slide 52 is thus movable into the track provided by the receivers 42. If the organizer 10 were turned upside down, the assemblies 14 have a tendency to slide out of the top of the tracks. If this is a problem, a simple latch (not shown) may be provided.

The ring binder assemblies 14 also comprise a spine 62 rigid with the slide 52 from which extend a plurality of conventional separable ring sets 64 which are movable from an open position to receive perforated sheets to a closed position to retain the sheets therein. Typically, the ring sets 64 are opened by pushing on an actuator 66 of a conventional mechanism 68 inside the spine 62 which latches the ring sets 64 in the closed position. To close the ring halves 70, 72, they are merely pushed toward each other in a conventional manner. The ring sets 64 are preferably of the oval type, which allows greater side-to-side movement of the perforated pages and thus greater page capacity.

Figure 3:
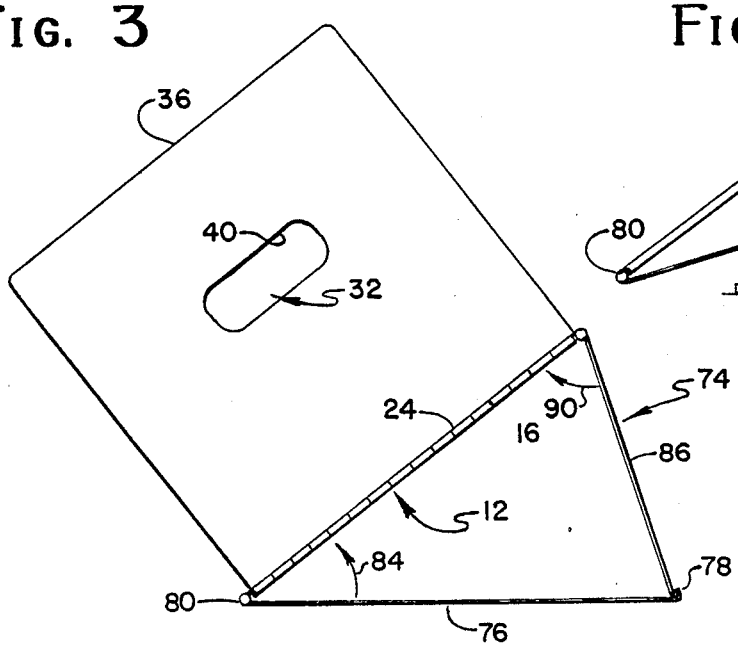
FIG. 3 is an end elevational view of the exhibit book of FIGS. 1 and 2, with the back cover in an upturned position illustrating a handle hole and illustrating a collapsible stand in a supporting position.

Referring to FIG. 3, a stand or support 74 for the organizer 10 comprises a planar base 76 having an upturned lip 78 on the free end thereof. The base 76 pivotally connects to the bottom of the backing member 12 by a piano hinge 80 including one or more helical springs 82 having end 83 acting on the backing member 12 and the base 76 to bias the base 76 toward the backing member 12, i.e. in the direction shown by the arrow 84. The stand 74 also comprises a planar strut 86 connected to the top of the backing member 12 by a piano hinge 88 having a spring 90 biasing the strut 86 toward the backing member 12 in the direction shown by the arrow 91. The strut 86 is free to move in both directions as shown by the arrow 90. The springs 82 are sufficiently strong to hold the base 76 substantially horizontal when the organizer 10 is held at an angle similar to that shown in FIG. 3. The spring 91 is weaker than the springs 82. The base 76 is sufficiently large that the backing member 12 nests inside the upturned lip 78 when the base 76 and strut 86 are flat against the backing member 12.

The stand 74 is manipulated by lifting the organizer 10 off a horizontal surface with the handle holes 30, 32. The organizer 10 is then tilted at an angle with a jerk. This causes the pivoted base 76 to move away from the backing member 12 and the strut 86 to fall toward a vertical position where the free end of the strut 86 engages the base 76. By tilting the book 10 appropriately, or by pushing the strut 86 toward the lip 78, the support 74 assumes the configuration shown in FIG. 3 where the lip 78 prevents additional counterclockwise movement of the strut 86. The organizer 10 is then placed on a horizontal surface and the backing member 12 and thus the binder assemblies 14 are accordingly supported at a convenient reading angle.

Figure 5:
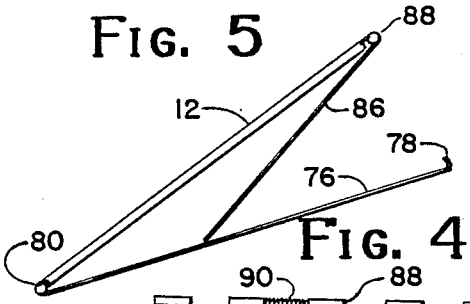
FIG. 5 is a schematic view of the supporting stand of this invention, illustrating a position between its collapsed position and its supporting position.
Figure 4:
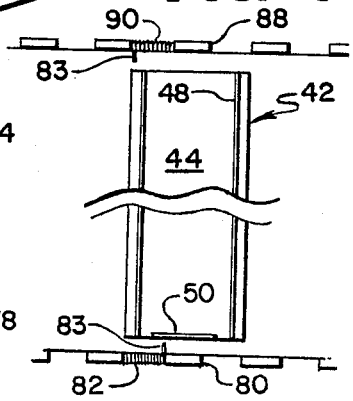
FIG. 4 is an enlarged top plan view of a receiver of the organizer of this invention.

In use, ring binder assemblies 14 which are substantially full of documents are logically or serially placed in the receivers 42. Because the abutments 50 are at the bottom of the slides, the organizer 10 can be lifted, in a normal fashion, without the assemblies 14 sliding out of the top. The organizer 10 is placed on a cart or table (not shown) and the support 74 manipulated to place the backing member 12 at a convenient reading angle. When the user is through with the organizer 10, it is lifted by the handle holes 30, 32 to a more tilted position as shown schematically in FIG. 5 and jiggled. When the base 76 moves away from the backing member 12, the strut 86 moves out of engagement with the lip 78 and moves to a position nearer the backing member to assume the configuration shown in FIG. 5. Because the strut 86 is no longer wedged by the lip 78 and is capable of sliding on the base 76, the stand 74 collapses when the organizer 10 is placed on a horizontal surface. If it is desired to store the documents in the ring binder assemblies 14, the binder assemblies 14 are removed from the organizer 10 and placed in a book capable of receiving a single binder assembly. Books receiving a single binder assembly 14 are of a convenient shape for storage.

When lifting the organizer 10 using handle holes in the front and back covers 18, 20, there is a tendency for the sheets in the binder assemblies 14 to cut the user's fingers exposed through the holes. This is particularly true when the handle holes are spaced relatively close to the edges 34, 36, i.e. when the handle holes are close enough to the edges 34, 36 so the thumb can be placed over the edges 34, 36. By spacing the lifting edges 38, 40 further than about 3½ inches from the edges 34, 36, which is the approximate span of an adult human from the base of the thumb to the second or middle joint of the fingers, paper in the ring sets 64 are not apt to cut the user's fingers. The natural tendency is for the user to tilt the front and back covers 18, 20 to a position as shown in FIG. 2 and then insert the fingers through the handle holes 30, 32. With the covers 18, 20 in the position of FIG. 2, the user's fingers are closer to the axes 22, 24 than the cutting edges of the first and last sheets in the binder assemblies. Viewed differently, the lifting edges 38, 40 are spaced from the axes 22, 24 a distance less than the distance of the sheets 92 from the perforations 94 to the cutting edge 96 when the covers 18, 20 are at 30°–45° relative to the backing member 12. For letter size paper, the lifting edges 38, 40 are less than about 8 inches from the axes 26, 28. The tendency of paper in the ring sets 64 to cut the user's fingers may also be reduced by placing less flexible dividers 98 in the ring sets 64.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A document organizer comprising a rigid backing member having plural parallel receivers for ring binder assemblies;

a front cover and a back cover pivotally connected to the backing member for movement about spaced first and second generally parallel axes; and a plurality of ring binder assemblies including a rigid central segment in the receivers, a plurality of separable ring sets and means for latching the ring sets closed, the ring binder assemblies being free from rigid front and back covers parallel to the backing member front and back covers.

2. The document organizer of claim 1 comprising a piano hinge between the backing member and the front and a piano hinge between the backing member and the back.

3. The document organizer of claim 1 wherein the front and back covers are slightly greater than letter size and have a free edge opposite from the rigid backing member and provide an elongate handle hole spaced from the free edge a distance greater than the span of an adult human hand from the base of the thumb to the second joint of the fingers.

4. The document organizer of claim 1 further comprising paper having perforations adjacent a first edge received in the ring sets and a second edge defining a predetermined width from the perforations to the second edge and wherein the front and back covers have a free edge opposite from the rigid backing member and provide an elongate handle hole having a lifting edge spaced from the axis a distance less than the predetermined width.

5. The document organizer of claim 1 wherein the binder receivers each include a central planar section rigid with the backing member and having a pair of parallel side edges and a pair of lips converging from the side edges away from the backing member, the central planar section and the converging lips defining a track and the ring binder assembly central section being received in the track.

6. The document organizer of claim 5 wherein the binder assemblies include a rigid slide having a central section and a pair of diverging sides, the slide being sized to snugly fit the track.

7. The document organizer of claim 1 further comprising a collapsible supporting stand including a base and means pivotally connecting the base to a bottom edge of the backing member and biasing the base toward the backing member;

a strut and means pivotally connecting the strut to a top edge of the backing member; and a spring biasing the strut toward the backing member.

8. The document organizer of claim 7 wherein the base includes an upturned lip thereon, the base, backing member and strut defining a triangle in a supporting position of the strut wherein the strut abuts the upturned lip, the angle between the strut and the base being an acute angle in the supporting position of the strut, the spring biasing the strut toward the base in the supporting position of the strut and being prevented from moving the strut because of the angular relation between the strut and the base.

9. The document organizer of claim 1 wherein the receivers are rigid with the backing member and wherein the receivers comprise means constraining the ring binder assemblies against movement in a path perpendicular to the rigid backing member.

10. A document organizer comprising a rigid spine having plural parallel binder receivers;

a front cover and a back cover connected to the rigid spine for pivotal movement about spaced axes and having a free edge spaced from the spine and a handle hole spaced from the free edge a distance greater than the span of an adult hand from the base of the thumb to the middle joint of the fingers;

a plurality of ring binder assemblies received in the binder receivers, the ring binder assemblies including a rigid central section connected with the rigid spine having a plurality of separable ring sets for receiving perforated sheets therein and means for latching the ring sets closed.

11. A document organizer comprising a rigid spine having plural parallel binder receivers;

a front cover and a back cover connected to the rigid spine for pivotal movement about spaced axes and having a free edge spaced from the spine and a handle hole having a lifting edge;

a plurality of ring binder assemblies received in the binder receivers having a plurality of separable ring sets and means for latching the ring sets closed; and sheets having perforations adjacent a first edge received in the ring sets and a second edge defining a predetermined width from the perforations to the second edge, the lifting edge being spaced from the axes a distance less than the predetermined width.

* * * * *